US011035605B2

(12) United States Patent
Park et al.

(10) Patent No.: US 11,035,605 B2
(45) Date of Patent: Jun. 15, 2021

(54) REFRIGERATOR AND METHOD FOR CONTROLLING SAME, USING A DIFFERENTIAL PRESSURE SENSOR FOR DEFROST CONTROL

(71) Applicant: LG ELECTRONICS INC., Seoul (KR)

(72) Inventors: Kyongbae Park, Seoul (KR); Wookyung Baik, Seoul (KR); Sangbok Choi, Seoul (KR); Sungwook Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 98 days.

(21) Appl. No.: 16/349,103

(22) PCT Filed: Nov. 10, 2017

(86) PCT No.: PCT/KR2017/012732
§ 371 (c)(1),
(2) Date: May 10, 2019

(87) PCT Pub. No.: WO2018/088843
PCT Pub. Date: May 17, 2018

(65) Prior Publication Data

US 2019/0277554 A1 Sep. 12, 2019

(30) Foreign Application Priority Data

Nov. 11, 2016 (KR) ..... 10-2016-0150248

(51) Int. Cl.
*F25D 21/00* (2006.01)
*F25B 13/00* (2006.01)
(Continued)

(52) U.S. Cl.
CPC ..... *F25D 21/008* (2013.01); *F25B 13/00* (2013.01); *F25D 17/06* (2013.01); *F25D 21/00* (2013.01);
(Continued)

(58) Field of Classification Search
CPC ..... F25B 2700/11; F25D 17/06; F25D 21/00; F25D 21/002; F25D 21/025
(Continued)

(56) References Cited

U.S. PATENT DOCUMENTS 3,309,887 A 3/1967 Jacobus
5,657,638 A * 8/1997 Erdman ..... F25D 17/062 62/158
(Continued)

FOREIGN PATENT DOCUMENTS

CN 101738054 6/2010
CN 203848587 9/2014
(Continued)

OTHER PUBLICATIONS

PCT International Search Report and Written Opinion in International Application No. PCT/KR2017/012732, dated Feb. 13, 2018, 14 pages (with English translation).
(Continued)

*Primary Examiner* — Henry T Crenshaw
(74) *Attorney, Agent, or Firm* — Fish & Richardson P.C.

(57) ABSTRACT

The resent invention provides a refrigerator comprising: a cabinet having a storage chamber; a door for opening and closing the storage chamber; a case having a discharge port through which air is discharged to the storage chamber; an evaporator provided inside the case and for supplying cold air by means of heat exchange with air; a fan installed on the discharge port and for generating the airflow discharging to the storage chamber the air which has been heat exchanged
(Continued)

in the evaporator; and a differential pressure sensor having a first pipe, of which one end is positioned on a part where the air is withdrawn to the fan, and a second pipe of which one end is positioned on a part where the air is discharged from the fan.

20 Claims, 6 Drawing Sheets

(51) Int. Cl.
*F25D 29/00* (2006.01)
*F25D 21/02* (2006.01)
*F25D 21/08* (2006.01)
*F25D 17/06* (2006.01)

(52) U.S. Cl.
CPC ..... *F25D 21/02* (2013.01); *F25D 21/08* (2013.01); *F25D 29/00* (2013.01)

(58) Field of Classification Search
USPC ..... 62/151
See application file for complete search history.

(56) References Cited

U.S. PATENT DOCUMENTS 5,692,385 A * 12/1997 Hollenbeck ..... F25D 21/002 62/140
6,401,708 B1 * 6/2002 Kim ..... F23N 5/242 126/116 A
2002/0139130 A1 * 10/2002 Collins ..... F25D 21/002 62/155
2011/0302937 A1 * 12/2011 Bujak, Jr. ..... F25D 21/125 62/80
2013/0042638 A1 * 2/2013 Eom ..... F25D 21/02 62/80
2013/0081416 A1 * 4/2013 Kim ..... F25D 21/02 62/151
2018/0306486 A1 * 10/2018 Alahyari ..... F25D 21/04

FOREIGN PATENT DOCUMENTS

| | | | |
|---|---|---|---|
| CN | 105783387 | | 7/2016 |
| JP | H04313672 | | 11/1992 |
| KR | 100120536 | | 10/1997 |
| KR | 1019990048872 | | 7/1999 |
| KR | 100238060 | | 1/2000 |
| KR | 1020000056850 | | 9/2000 |
| KR | 2001-0076890 | * | 8/2001 |
| KR | 1020010076890 | | 8/2001 |
| KR | 100304907 | | 9/2001 |
| KR | 1020040094875 | | 11/2004 |
| KR | 100652775 | | 12/2006 |

OTHER PUBLICATIONS

Chinese Office Action in Chinese Application No. 201780068356.0, dated Jun. 23, 2020, 18 pages (with English translation).
Extended European Search Report in European Application No. 17868581.4, dated May 8, 2020, 10 pages.

* cited by examiner

REFRIGERATOR AND METHOD FOR CONTROLLING SAME, USING A DIFFERENTIAL PRESSURE SENSOR FOR DEFROST CONTROL

CROSS-REFERENCE TO RELATED APPLICATIONS

This application is a National Stage application under 35 U.S.C. § 371 of International Application No. PCT/KR2017/012732, filed on Nov. 10, 2017, which claims the benefit of Korean Patent Application No. 10-2016-0150248, filed on Nov. 11, 2016. The disclosures of the prior applications are incorporated by reference in their entirety.

TECHNICAL FIELD

The present invention relates to a refrigerator and a method for controlling the same, and more particularly, to a refrigerator having improved energy efficiency and a method for controlling the same.

BACKGROUND ART

In general, a refrigerator includes a machinery compartment, which is located at the lower part of a main body of the refrigerator. The machinery compartment is generally installed at the lower part of the refrigerator in consideration of the center of gravity of the refrigerator and in order to improve assembly efficiency and to achieve vibration reduction.

A refrigeration cycle device is installed in the machinery compartment of the refrigerator in order to keep the interior of the refrigerator frozen/refrigerated using the property of a refrigerant, which absorbs external heat when a low-pressure liquid refrigerant is changed to a gaseous refrigerant, whereby food is kept fresh.

The refrigeration cycle device of the refrigerator includes a compressor for changing a low-temperature, low-pressure gaseous refrigerant to a high-temperature, high-pressure gaseous refrigerant, a condenser for changing the high-temperature, high-pressure gaseous refrigerant, changed by the compressor, to a low-temperature, low-pressure liquid refrigerant, and an evaporator for changing the low-temperature, high-pressure liquid refrigerant, changed by the condenser, to a gaseous refrigerant in order to absorb external heat.

When the compressor is driven, the temperature of the evaporator is lowered, whereby ice may be formed on the evaporator. When the amount of ice formed on the evaporator increases, the efficiency of heat exchange between the evaporator and air is lowered, which makes it difficult to smoothly cool air to be supplied to a storage compartment. As a result, the compressor is required to be driven a larger number of times for a longer time.

In addition, when ice is formed on the evaporator, a heater is driven to remove the ice from the evaporator. When the heater is unnecessarily frequently driven, the amount of power consumed by the refrigerator increases.

In particular, power consumption of refrigerators produced in recent years has increased according to increase in storage capacity of the refrigerators. Research has thus been conducted into reduction of power consumption.

DISCLOSURE

Technical Problem

An object of the present invention is to provide a refrigerator having improved energy efficiency and a method for controlling the same.

Another object of the present invention is to provide a refrigerator capable of determining whether operation of the refrigerator is normally performed, and a method for controlling the same.

Another object of the present invention is to provide a refrigerator capable of determining a defrosting time using a differential pressure sensor and a method for controlling the same.

Technical Solution

The object of the present invention can be achieved by providing a refrigerator including a cabinet provided with a storage compartment, a door configured to open and close the storage compartment, a case having a discharge port, air being discharged into the storage compartment through the discharge port, an evaporator provided in the case to perform heat exchange with air to supply cooled air, a fan installed at the discharge port and configured to generate an air flow for discharging the air heat-exchanged by the evaporator to the storage compartment, and a differential pressure sensor provided with a first conduit having one end positioned at a portion through which air is drawn to the fan, and a second conduit having one end positioned at a portion through which air is discharged from the fan.

The first conduit may sense a pressure of flow of the air drawn to the fan.

The second conduit may sense a pressure of flow of the air discharged from the fan.

The differential pressure sensor may sense a difference between pressures measured by the first conduit and the second conduit.

The first conduit may have a first through hole formed at one end thereof, wherein the first through hole may be disposed perpendicular to the air flow generated by the fan.

The second conduit may have a second through hole formed at one end thereof, wherein the second through hole may be disposed perpendicular to the air flow generated by the fan.

The fan may be disposed between one end of the first conduit and one end of the second conduit.

The first conduit may be exposed to a low pressure portion subjected to a relatively low pressure and the second conduit may be exposed to a high pressure portion subjected to a relatively high pressure.

The refrigerator may further include a controller configured to defrost the evaporator according to information sensed by the differential pressure sensor.

The refrigerator may further include a heater provided in the case, wherein the controller may drive the heater to defrost the evaporator.

The refrigerator may further include a door switch configured to sense whether the door opens or closes the storage compartment, wherein, when the door senses the door close the storage compartment, the controller may sense a pressure difference by the differential pressure sensor.

The refrigerator may further include a timer configured to measure an elapse time, wherein the controller may sense the pressure difference by the differential pressure sensor when a time determined by the timer elapses.

When the fan is driven, the controller may sense a pressure difference by the differential pressure sensor.

In another aspect of the present invention, provided herein is a method for controlling a refrigerator, including sensing a pressure difference by a differential pressure sensor configured to measure a difference in pressure between a portion through which air is introduced into a fan and a portion through which the air is discharged from the fan, the fan discharging air heat-exchanged by an evaporator into a storage compartment, and defrosting the evaporator when the pressure difference is greater than a set pressure.

The method may further include determining whether the fan is driven before the sensing of the pressure difference.

The method may further include determining that a door for opening and closing the storage compartment closes the storage compartment before the sensing of the pressure difference.

The method may further include determining whether a predetermined time has elapsed after the door is closed.

The defrosting of the evaporator may include driving a heater configured to heat the evaporator.

The defrosting of the evaporator may include terminating the driving of the heater to terminate the defrosting when a temperature of the evaporator reaches a set temperature.

The sensing of the pressure difference may include rotating the fan at a constant rotational speed.

Advantageous Effects

According to the present invention, since information necessary for a refrigerator is obtained using one differential pressure sensor, errors according to measurement may be reduced, compared to the case where two or more sensors are used. When two values are compared using two or more sensors, different influences may be caused by temperatures at the positions where the respective sensors are installed, turbulence, door opening/closing, and thus different errors may be generated in the two sensors. Accordingly, when the values of two sensors are compared with each other, the error may be larger than when one sensor is used.

Further, according to the present invention, compared to the case where two pressure sensors are used, power consumption may be reduced and necessary resources such as wires for installing two pressure sensors may be reduced.

Further, according to the present invention, since termination of defrosting is determined by the information measured by an evaporator temperature sensor, reliability of determination of the defrosting termination may be secured. Further, since defrosting is terminated according to the temperature sensed by the evaporator temperature sensor, the number of times of driving the heater to defrost the evaporator may be reduced, thereby reducing the actual power consumption.

BEST MODE

Figure 1:
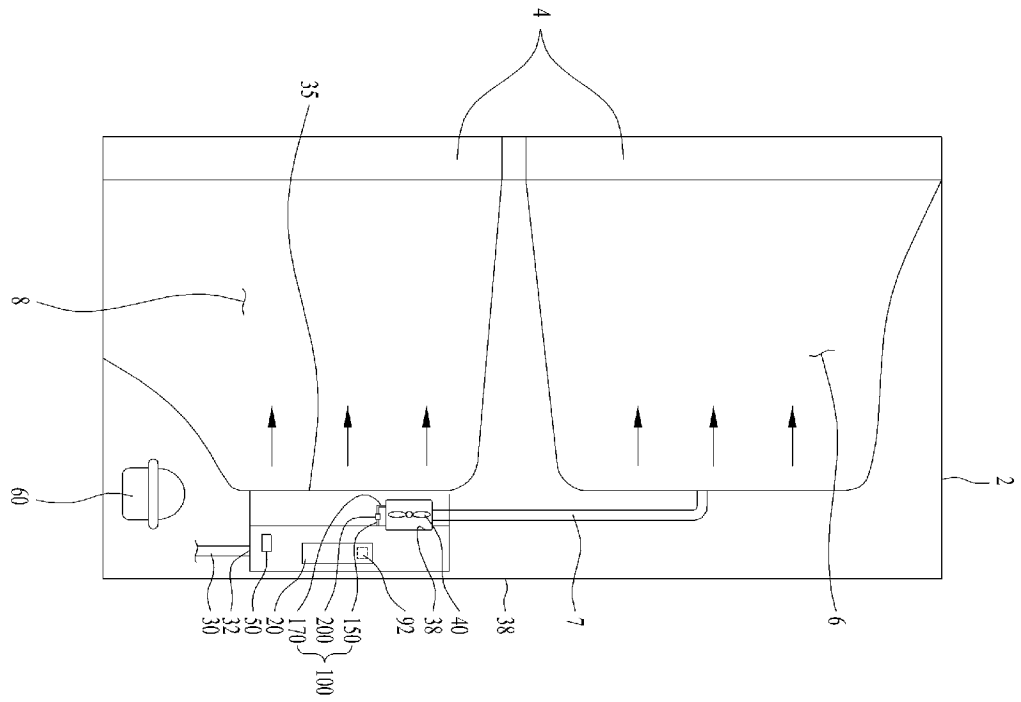
FIG. 1 is a side cutaway view of a refrigerator according to one embodiment of the present invention.

Hereinafter, preferred embodiments of the present invention capable of realizing the above object will be described with reference to the accompanying drawings.

It will be appreciated that for simplicity and clarity of illustration, the dimensions or shapes of some of the elements shown in the drawings may be exaggerated. In addition, terms specifically defined in consideration of the configuration and operation of the present invention may be replaced by other terms based on intensions of the user or operator, customs, or the like. The terms used herein should be construed based on the whole content of this specification.

In an embodiment of the present invention, one differential pressure sensor is used, which is a technical difference from a case where two pressure sensors are used. When two pressure sensors are used, the pressure difference between the two positions may be calculated using pressures measured by the two pressure sensors.

Generally, a pressure sensor measures pressure in units of 100 Pa. In the embodiment of the present invention, a differential pressure sensor is adopted and thus a pressure difference may be more precisely measured than when a general pressure sensor is used. The differential pressure sensor cannot measure the absolute pressure value at the measurement position, but facilitates measurement of a difference in small units compared to the general pressure sensor because the differential pressure sensor can calculate a pressure difference between two positions.

When two pressure sensors are used, a large cost and many resources such as wires for installing the two sensors are required because the two sensors are applied. On the other hand, using one differential pressure sensor may reduce the cost and resources for installing the sensor.

Hereinafter, preferred embodiments of the present invention capable of realizing the above object will be described with reference to the accompanying drawings.

Figure 2:
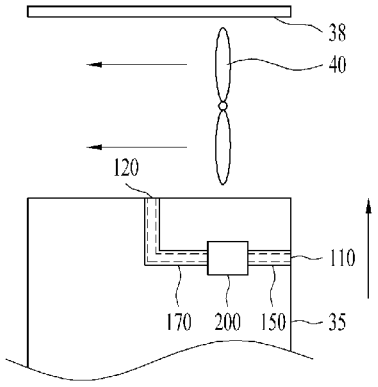
FIG. 2 is a conceptual diagram of one embodiment.

FIG. 1 is a side cutaway view of a refrigerator according to one embodiment of the present invention, and FIG. 2 is a conceptual diagram of one embodiment.

Hereinafter, description will be given with reference to FIGS. 1 and 2.

The refrigerator includes a cabinet 2 having a plurality of storage compartments 6 and 8 and a door 4 for opening and closing the storage compartments 6 and 8.

The plurality of storage compartments 6 and 8 may be divided into a first storage compartment 6 and a second storage compartment 8. Each of the first storage compartment 6 and second storage compartment 8 may form a refrigeration compartment or a freezer compartment. Alternatively, first storage compartment 6 and the first storage compartment 6 may be configured as a freezer compartment and a refrigeration compartment, respectively. Alternatively, both the first storage compartment 6 and the first storage compartment 6 may configured as refrigeration compartments or freezer compartments.

A case 35 for accommodating an evaporator 20 is provided at the rear of the storage compartments.

The case 35 is provided with a discharge port 38, through which air can be supplied from the case 35 to the storage compartments, and an introduction port 32, through which air is supplied from the storage compartments to the case 35.

The introduction port 32 is provided with an introduction duct 30, through which air is guided into the case 35. Thus, the introduction duct may connect the storage compartments 6 and 8 with the case 35 to form an air flow passage.

The discharge port 38 may be provided with a fan 40 to cause an air flow by which air inside the case 35 can be moved to the storage compartments 6 and 8. Since the case 35 has an entirely closed configuration except for the introduction port 32 and the discharge port 38, an air flow from the introduction port 32 to the discharge port 38 is generated when the fan 40 is driven.

A duct 7 for guiding air to the first storage compartment 6 is provided, and thus cold air passing through the fan 40 may be supplied to the first storage compartment 6. The air that passing through the fan 40 may also be supplied to the second storage compartment 8.

The evaporator 20 is accommodated in the case 35. In the evaporator, a refrigerant compressed by a compressor 60 is vaporized to cool the air. The air inside the case 35 is cooled through heat exchange with the evaporator 20.

A heater 50 configured to generate heat to defrost the evaporator 20 is provided below the evaporator 20. The heater 50 need not be installed below the evaporator 20. The heater may be provided anywhere in the case 35 as long as it can heat the evaporator 20.

The evaporator 20 is provided with an evaporator temperature sensor 92, which may measure the temperature of the evaporator 20. The evaporator temperature sensor 92 may sense a low temperature when the refrigerant passing through the inside of the evaporator 20 is vaporized, and may sense a high temperature when the heater 50 is driven.

The compressor 60 may be installed in a machinery compartment, which is provided to the cabinet 2, and may compress the refrigerant to be supplied to the evaporator 20. The compressor 60 is installed outside the case 35.

The introduction port 32 is located below the evaporator 20 and the discharge port 38 is located above the evaporator 20. The discharge port 38 is disposed at a higher position than the evaporator 20, and the introduction port 32 is disposed at a lower position than the evaporator 20.

Accordingly, when the fan 40 is driven, the air moves upward in the case 35. The air introduced through the introduction port 32 undergoes heat exchange as it passes by the evaporator 20, and is discharged from the case 35 through the discharge port 38

A differential pressure sensor 100 configured to measure a difference in pressure is provided at a portion adjacent to the discharge port 38.

The discharge port 38 is provided with the fan 40, which generates an air flow for discharging the air heat-exchanged with the evaporator 20 into the storage compartments. When the fan 40 is driven, the air inside the case 35 may be moved to the storage compartments through the discharge port 38.

The differential pressure sensor 100 includes a first through hole 110 located at a portion through which air is drawn into the fan 40 and a second through hole 120 located at a portion through which air is discharged from the fan 40.

The differential pressure sensor 100 includes a first conduit 150 provided with a first through hole 110 at one end thereof and a second conduit 170 provided with the second through hole 120 at one end thereof.

The differential pressure sensor 100 includes a body portion connecting the first through hole 110 and the second through hole 120. The body portion includes the first conduit 150 provided with the first through hole 110, the second conduit 170 provided with the second through hole 120, and a connection member 200 connecting the first conduit 150 and the second conduit 170 to each other.

Here, the connection member 200 may be disposed at a higher position than the evaporator 20, such that water condensed on the evaporator 20 is not dropped onto the connection member 200. The connection member 200 may be installed to be embedded in the case 35 as shown in FIG. 2. Alternatively, the connection member 200 may be installed on one side of the case 35.

An electronic device may be installed on the connection member 200 because it is very likely to be damaged when contacting water drops. The water drops formed on the evaporator 20 will fall down due to gravity. When the connection member 200 is disposed above the evaporator 20, the water drops formed on the evaporator 20 will not fall onto the connection member 200.

The first through hole 110 and the second through hole 120 may be arranged perpendicular to the direction of an air flow generated by the fan 40.

The first conduit 150 may sense the pressure of an air flow drawn into the fan 40. In order to measure the static pressure of the air moving from the first conduit 150 to the fan 40, the first through hole 110 may be disposed perpendicular to the air flow for the fan 40.

As shown in FIG. 2, air is moved upward in the case 35 (corresponding to the right side in FIG. 2) by the fan 40. Accordingly, the first through hole 110 arranged perpendicular to the upward movement direction may sense the static pressure of air that moves upward.

The second conduit 170 may sense the pressure of an air flow discharged from the fan 40. In order for the second conduit 170 to measure the static pressure of the air moving from the fan 40, the second through hole 120 may be disposed perpendicular to the air flow of the fan 40.

As shown in FIG. 2, the air discharged from the case 35 through the discharge port 38 is horizontally moved from right to left. Accordingly, the second through hole 120 may be vertically positioned with respect to the horizontal movement direction to sense a static pressure of the horizontally moving air.

The first conduit 150 and the second conduit 170 may be connected to each other by the connection member 200.

The differential pressure sensor 100 senses a pressure difference between air passing by the first through hole 110 and air passing by the second through hole 120. The pressure difference is generated because the through holes are arranged with the fan 40 placed therebetween. The second through hole 120 is a high pressure portion subjected to a relatively high pressure, and the first through hole 110 is a low pressure portion subjected to a relatively low pressure. Accordingly, the differential pressure sensor 100 senses the pressure difference. The first conduit 150 is exposed to the low pressure portion subjected to a relatively low pressure, while the second conduit 170 is exposed to the high pressure portion subjected to a relatively high pressure.

A portion of the fan 40 to which air is drawn may be a low pressure portion because air leaves therethrough, and a portion of the fan 40 from which air is discharged may be a high pressure portion. Accordingly, a pressure difference is generated across the fan 40.

In particular, when the fan 40 is driven, an air flow is generated in the case 35, and thus the pressure difference may be measured by the differential pressure sensor 100.

The fan 40 is disposed between one end of the first conduit 150 and one end of the second conduit 170. That is, because the fan 40 is disposed between the first through hole 110 and the second through hole 120, and an air flow is generated by the fan 40, there may be a difference between the pressured measured in the first through hole 110 and the pressured measured in the second through hole 120.

Figure 3:
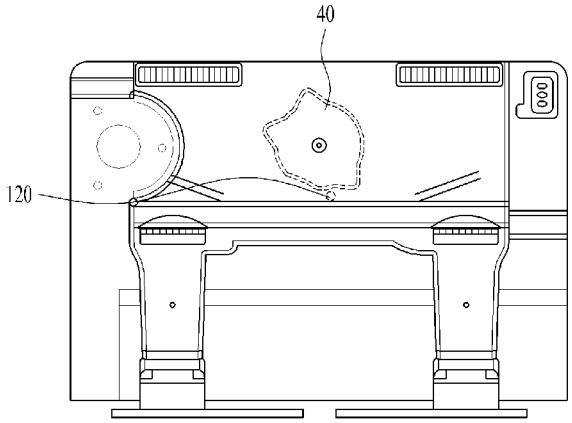
FIG. 3 is a view showing a portion to which one end of a first conduit of a differential pressure sensor is exposed.
Figure 4:
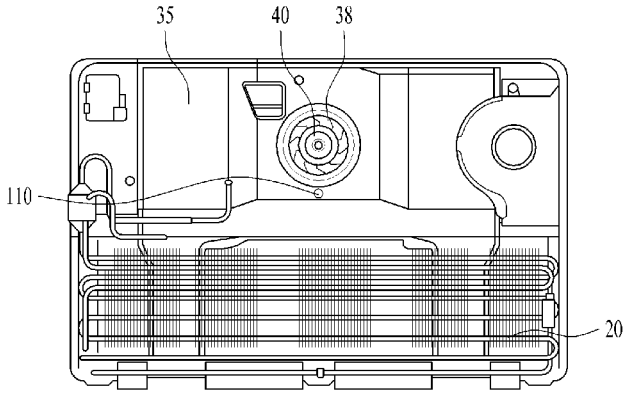
FIG. 4 is a view showing a portion to which one end of a second conduit of the differential pressure sensor is exposed.

FIG. 3 is a view showing a portion to which one end of a first conduit of a differential pressure sensor is exposed, and FIG. 4 is a view showing a portion to which one end of a second conduit of the differential pressure sensor is exposed.

As shown in FIG. 3, the first through hole 110 of the first conduit 150 is exposed to a portion of the case 35 where the evaporator 20 is located.

The first through hole 110 may be disposed at a position higher than that of the evaporator 20 but lower than that of the fan 40 to sense the pressure of air that rises up toward the fan 40. For reference, since the present invention employs one differential pressure sensor, the value of the pressure measured in the first through hole 110 is not an absolute but a value comparable with the value measured in the second through hole 120. Thus, information for measuring a final pressure difference is obtained.

FIGS. 3 and 4 show an example in which a centrifugal fan is installed among other kinds of fans.

Since the first through hole 110 is disposed on the path along which air is drawn to the fan 40, information for determining the pressure difference may be obtained through the first through hole 110.

Since the first through hole 110 is disposed above the evaporator 20, water drops cannot enter the through hole 110 even when defrosting of the evaporator 20 is performed and thus the ice formed on the evaporator 20 melts. Thus, the first through hole 110 may be prevented from being clogged even if the evaporator 20 is defrosted. Accordingly, a measurement error of the differential pressure sensor 100 may be reduced.

The second through hole 120 is disposed at a portion of the fan 40 from which air is discharged. Since the fan 40 is specified as a centrifugal fan in contrast with the case of FIGS. 1 and 2, the air discharged from the fan 40 in FIG. 4 is guided downward from the fan 40.

Accordingly, the second through hole 120 may be disposed perpendicular to the downward movement direction of air to obtain information for sensing a pressure difference.

For reference, in FIG. 4, the air discharged by the fan 40 is guided to a branch duct, and is then moved to the storage compartments along the respective ducts through the communication holes connected to the storage compartments. Here, the air discharged by the fan 40 is moved from the center of the fan 40 in a direction away from the center of the fan 40.

Figure 5:
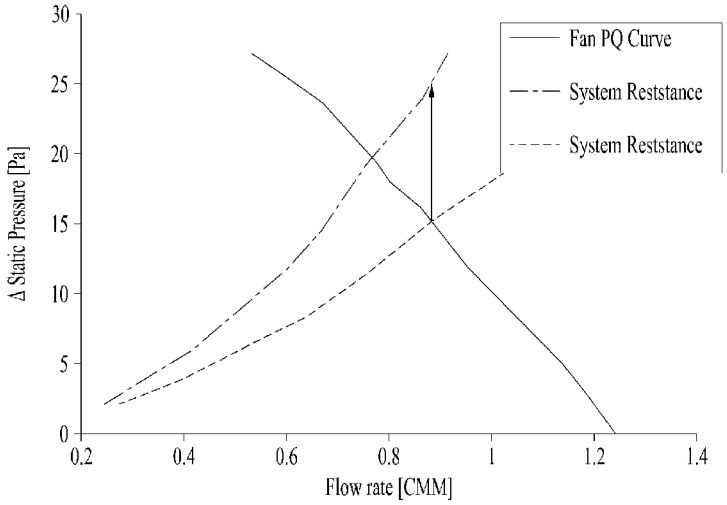
FIG. 5 depicts an embodiment.

FIG. 5 depicts an embodiment.

In FIG. 5, the x-axis represents the flow rate and the y-axis represents the difference in static pressure. The pressure difference on the y-axis may refer to the pressure difference value measured by the differential pressure sensor.

The dotted line in the graph depicts the pressure difference according to the flow rate when no ice is formed on the evaporator 20.

The one-dot chain line in the graph depicts the pressure difference according to the flow rate when ice is formed on the evaporator 20 to such an extent that defrosting is needed.

The solid line in the graph depicts change in pressure with change in flow rate under the condition that the same input voltage is applied to the fan and the fan is rotated at substantially the same rpm.

As can be seen from FIG. 5, when ice is formed on the evaporator 20, the pressure difference measured by the differential pressure sensor 100 increases as the flow rate by the fan 40 decreases.

That is, when the pressure difference measured by the differential pressure sensor 100 increases, ice may be expected to be formed on the evaporator 20. Here, if the pressure difference measured by the differential pressure sensor 100 is greater than a predetermined value, it may be determined that ice has been formed on the evaporator 20 to such an extent that defrosting of the evaporator 20 is needed.

Figure 6:
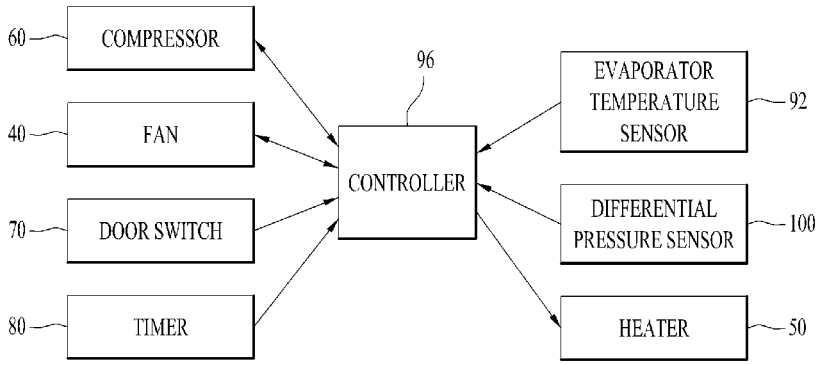
FIG. 6 is a control block diagram according to an embodiment of the present invention.

FIG. 6 is a control block diagram according to an embodiment of the present invention.

Referring to FIG. 6, the present invention includes a compressor 60 capable of compressing the refrigerant. The controller 96 may drive the compressor 60 to supply cooled air to the storage compartments when it is necessary to cool the storage compartment. Information on whether the compressor 60 is driven may be transmitted to the controller 96.

The present invention further includes a fan 40 configured to generate an air flow for supplying cooled air to the storage compartments. Information on whether the fan 40 is driven may be transmitted to the controller 96, and the controller 96 may transmit a signal instructing that the fan 40 should be driven.

Door switches 70 capable of obtaining information on whether the doors 4 for opening and closing the storage compartments open or close the storage compartments is provided. The door switches 70 may be individually provided to the respective doors to sense whether each door opens or closes the storage compartments.

In addition, a timer 80 configured to sense an elapse time is provided. The time measured by the timer 80 is transmitted to the controller 96. For example, after the controller 96 obtains, from the door switches 70, signals indicating that the doors 4 close the storage compartments, the controller may receive information about the time that elapses after the doors 4 close the storage compartments, according to the time measured by the timer 80.

When defrosting is performed, the temperature information measured by the evaporator temperature sensor 92, which is capable of measuring the temperature of the evaporator, may also be transmitted to the controller 96. The controller 96 may terminate defrosting of the evaporator according to the temperature information measured by the evaporator temperature sensor 92.

Further, a heater 50 configured to heat the evaporator may be provided, and the controller 96 may issue a command to drive the heater 50. When the defrosting operation is started, the controller 96 may drive the heater 50. When the defrosting operation is completed, the controller 96 may stop driving the heater 50.

Figure 7:
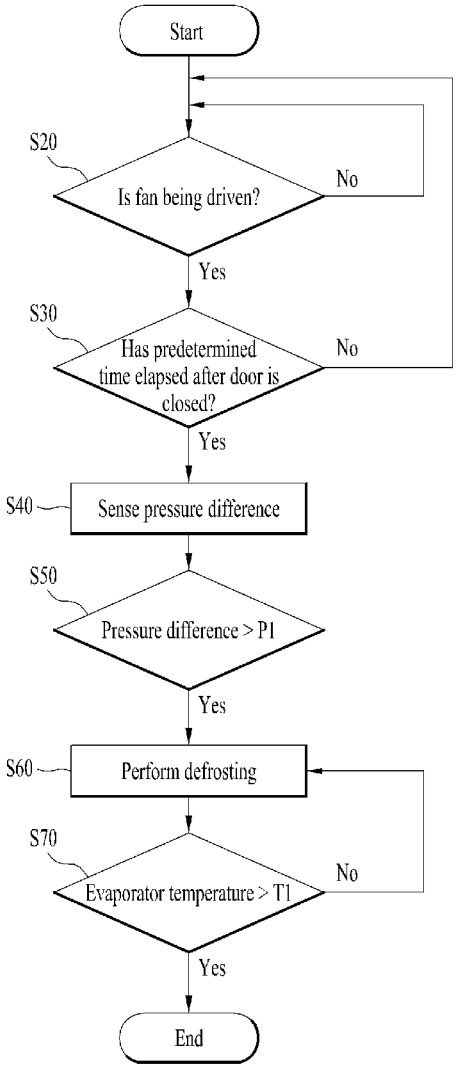
FIG. 7 is a control flowchart for sensing frosting of the evaporator according to one embodiment.

FIG. 7 is a control flowchart of sensing frosting of the evaporator according to one embodiment.

Referring to FIG. 7, an embodiment of the present invention includes sensing a pressure difference by one differential pressure sensor 100 configured to measure a difference in pressure between a portion through which air is introduced into a fan 40 for discharging air heat-exchanged by the evaporator 20 to the storage compartments 6 and 8, and a portion through which air is discharged from the fan 40, and defrosting the evaporator 40 when the pressure difference is greater than a set pressure.

As used herein, the term pressure difference may refer to a pressure difference value measured once, or an average value of pressure differences measured several times. The pressure measured by the differential pressure sensor 100 may temporarily have an anomalous value due to various external factors. When an average value of the pressure differences is used, reliability of the pressure difference measured by the differential pressure sensor 100 may increase.

If the pressure difference measured by the differential pressure sensor 100 is greater than a set pressure, this means that the pressure difference between the first through hole 110 and the second through hole 120 is large. The large pressure difference may mean that the amount of ice formed on the evaporator 20 is increased and the evaporator 20 has difficulty in performing smooth heat exchange. In this case, cooled air is not smoothly supplied from the evaporator 20 to the storage compartments 6 and 8, and thus defrosting may be needed.

Before the pressure difference is sensed, it may be determined whether the fan 40 is being driven (S20).

Only when the fan 40 is driven, an air flow may be generated between the first through hole 110 and the second through hole 120 in the differential pressure sensor 100, and the differential pressure sensor 100 may smoothly measure the pressure difference.

Accordingly, when the fan 40 is not driven, the differential pressure sensor 100 may not measure the pressure difference.

The door switch 70 may determine whether a predetermined time has elapsed after the door 4 closes the storage compartments 6 and 8. If the predetermined time has not elapsed, the differential pressure sensor 100 may not sense the pressure difference (S30). The timer 80 may measure the elapse time after the door switch 70 determines whether the door 4 is closed. Here, the elapse time may refer to approximately 1 minute, but may be changed to various values.

If the door 4 has not closed the storage compartments 6 and 8, the air flow in the case 35 may be changed.

If the predetermined time has not elapsed after the door 4 is closed, an unexpected air flow to the introduction port 32 or the discharge port 38 may be generated by closing of the door 4.

Therefore, in this case, when the pressure difference is measured by the differential pressure sensor 100, the measured pressure difference may provide erroneous information. If the defrosting time of the evaporator 20 is determined using such erroneous information, the heater 50 may be driven unnecessarily frequently or may not defrost the evaporator 20 by driving the heater 50 when defrosting is needed.

A pressure difference between the first through hole 110 and the second through hole 120 is measured by the differential pressure sensor 100 (S40). Then, the information on the measured pressure difference may be transmitted to the controller 96.

When the differential pressure sensor 100 measures the pressure difference, the controller 96 may maintain constant rpm of the fan 40 by setting the input voltage to the fan 40 to be constant.

When the rpm of the fan 40 changes, the pressure difference varies with the flow rate of the fan 40 according to another trend (along a plurality of lines rather than one line as shown in FIG. 5), accordingly the pressure difference measured by the differential pressure sensor 100 varies. Therefore, it may not be accurately determined whether the evaporator 20 has been frosted to an extent that defrosting is needed, based on the pressure difference measured by the differential pressure sensor 100. Therefore, in one embodiment, the input voltage to the fan 40 may be kept constant such that the differential pressure sensor 100 can sense only the pressure difference corresponding to the amount of ice formed on the evaporator 20 with the other conditions unchanged The controller 96 compares the measured pressure difference, that is, the differential pressure, with the set pressure P1 (S50). When the differential pressure is greater than the set pressure P1, it may be determined that a large amount of ice has been formed on the evaporator 20 and thus defrosting is needed. When a large amount of ice is formed on the evaporator 20, it is difficult for the evaporator 20 to sufficiently perform heat exchange, and thus it is difficult to supply sufficient cold air to the storage compartments 6 and 8. The set pressure P1 may be set to about 20 Pa, but may be changed in consideration of the capacity, size, and the like of the refrigerator.

The controller 96 drives the heater 50 to supply heat to the evaporator 20 to perform defrosting by (S60). The evaporator 20 and the heater 50 are disposed in the same partitioned space inside the case 35. Accordingly, when the heater 50 is driven, the temperature inside the case 35 may be increased, thereby increasing the temperature of the evaporator 20.

Then, the ice that has adhered to the evaporator 20 may be partially melted and turned into water. A part of the ice may be detached from the evaporator 20 as it melts. Then, the area of the evaporator 20 that can come into direct thermal contact with air may be increased, thereby improving heat exchange efficiency of the evaporator 20.

The evaporator temperature sensor 92 measures the temperature of the evaporator 20 while defrosting is being performed, i.e., while the heater 50 is being driven. When the temperature of the evaporator 20 increases above the predetermined temperature T1, it is determined that the evaporator 20 has been sufficiently defrosted (S70).

That is, the controller 96 may stop driving the heater 50. Increase in temperature of the evaporator 20 above the set temperature T1 may indicate a state in which the evaporator 20 can change to a condition in which cold air can be supplied to the storage compartments 6 and 8, rather than meaning that ice formed on the evaporator 20 is entirely removed.

If the temperature of the evaporator 20 is not increased to the predetermined temperature T1, it may be determined that the evaporator 20 has not been sufficiently defrosted, and thus the heater 50 may continue to be driven to supply heat.

In one embodiment, the defrosting time for the evaporator 20 is determined by the differential pressure measured by the differential pressure sensor 100. In order to improve reliability of the differential pressure value measured by the differential pressure sensor 100, a condition for stabilizing the air flow inside the case 35 may be added.

If defrosting of the evaporator 20 is excessively frequently performed, the heater 50 is frequently driven and the power consumption of the heater 50 is increased, thereby lowering the overall energy efficiency of the refrigerator.

Further, if heat supplied from the heater 50 is transferred into the storage compartments 6 and 8 through the introduction port or the discharge port, the food stored in the storage compartments may be deteriorated. The evaporator 20 may also be required to supply more cooled air in order to cool the air heated by the heat supplied by the heater 50.

Therefore, in one embodiment, the defrosting time may be reliably determined, thereby reducing unnecessary power consumption and providing a refrigerator having energy efficiency improved as a whole and a method for controlling the same.

It is to be understood that the present invention is not limited to the disclosed embodiments, but, on the contrary, is intended to cover various modifications and equivalent arrangements included within the spirit and scope of the appended claims.

INDUSTRIAL APPLICABILITY

The present invention provides a refrigerator having improved energy efficiency and a method for controlling the same.

The invention claimed is:

1. A refrigerator comprising:

a cabinet that defines a storage compartment therein;

a door configured to open and close at least a portion of the storage compartment;

a case that defines a discharge port configured to discharge air into the storage compartment;

an evaporator disposed in the case and configured to perform heat exchange with air received in the case and to supply cooled air to the storage compartment;

a fan disposed at the discharge port and configured to generate air flow to discharge air heat-exchanged by the evaporator to the storage compartment; and a differential pressure sensor comprising a first conduit having a first end positioned at a first portion of the case through which air is drawn to the fan, and a second conduit having a second end positioned at a second portion of the case through which air is discharged from the fan, wherein the first end of the first conduit and the second end of the second conduit are disposed vertically above the evaporator, and wherein the differential pressure sensor is configured to measure a difference in air pressure between the first portion of the case and the second portion of the case.

2. The refrigerator according to claim 1, wherein the differential pressure sensor is configured to sense, at the first conduit, a first pressure of air flow drawn toward the fan.

3. The refrigerator according to claim 1, wherein the differential pressure sensor is configured to sense, at the second conduit, a second pressure of air flow discharged from the fan.

4. The refrigerator according to claim 1, wherein the differential pressure sensor is configured to sense a difference between a first air pressure measured at the first conduit and a second air pressure measured at the second conduit.

5. The refrigerator according to claim 1, wherein the first end of the first conduit defines a first through-hole that is open toward a direction perpendicular to the air flow generated by the fan.

6. The refrigerator according to claim 1, wherein the second end of the second conduit defines a second through-hole that is open toward a direction perpendicular to the air flow generated by the fan.

7. The refrigerator according to claim 1, wherein the fan is disposed between the first end of the first conduit and the second end of the second conduit.

8. The refrigerator according to claim 1, wherein the first conduit is exposed to the first portion of the case corresponding to a first air pressure, and the second conduit is exposed to the second portion of the case corresponding to a second air pressure that is greater than the first air pressure.

9. The refrigerator according to claim 1, further comprising:

a controller configured to defrost the evaporator based on information sensed by the differential pressure sensor.

10. The refrigerator according to claim 9, further comprising:

a heater disposed in the case, wherein the controller is configured to drive the heater to defrost the evaporator.

11. The refrigerator according to claim 9, further comprising:

a door switch configured to sense whether the door opens or closes at least the portion of the storage compartment, wherein the controller is configured to, based on the door switch sensing the door closing at least the portion of the storage compartment, control the differential pressure sensor to sense a pressure difference between a first air pressure at the first end of the first conduit and a second air pressure at the second end of the second conduit.

12. The refrigerator according to claim 11, further comprising:

a timer configured to measure a lapse of time, wherein the controller is further configured to control the differential pressure sensor to sense the pressure difference based on the lapse of time measured by the timer.

13. The refrigerator according to claim 9, wherein the controller is further configured to, based on the fan being driven, control the differential pressure sensor to sense a pressure difference between a first air pressure at the first end of the first conduit and a second air pressure at the second end of the second conduit.

14. A method for controlling a refrigerator including a cabinet that defines a storage compartment therein, an evaporator configured to exchange heat with air, a fan configured to generate air flow between the storage compartment and the evaporator, a case that accommodates the evaporator, and a differential pressure sensor configured to detect a difference of air pressure between portions of the case, the method comprising:

sensing, by the differential pressure sensor, a pressure difference between a first portion of the case through which air is introduced into the fan and a second portion of the case through which air is discharged from the fan; and defrosting the evaporator based on the pressure difference being greater than a set pressure, wherein the differential pressure sensor comprises a first conduit having a first end positioned at the first portion of the case, and a second conduit having a second end positioned at the second portion of the case, and wherein the first end of the first conduit and the second end of the second conduit are disposed vertically above the evaporator.

15. The method according to claim 14, further comprising:

determining whether the fan is driven before sensing the pressure difference.

16. The method according to claim 14, wherein the refrigerator further includes a door configured to open and close at least a portion of the storage compartment, wherein the method further comprises determining whether the door closes at least the portion of the storage compartment, and wherein sensing the pressure difference comprises sensing the pressure difference based on determining that the door closes at least the portion of the storage compartment.

17. The method according to claim 16, further comprising:

determining whether a predetermined time has elapsed after the door was closed.

18. The method according to claim 16, wherein defrosting the evaporator comprises:

driving a heater configured to heat the evaporator.

19. The method according to claim 18, further comprising:

terminating defrosting of the evaporator by terminating driving of the heater based on a temperature of the evaporator being greater than or equal to a set temperature.

20. The method according to claim 14, wherein sensing the pressure difference comprises:

sensing the pressure difference based on rotating the fan at a constant rotational speed.

* * * * *